US006000865A

United States Patent [19]

Takamizawa et al.

[11] Patent Number: 6,000,865

[45] Date of Patent: Dec. 14, 1999

[54] PRINTING APPARATUS AND A CONTROL METHOD THEREOF

[75] Inventors: Yuji Takamizawa; Mitsuaki Teradaira; Kazuhisa Aruga, all of Suwa, Japan

[73] Assignee: Seiko Epson Corporation, Tokyo, Japan

[21] Appl. No.: 08/978,850

[22] Filed: Nov. 26, 1997

Related U.S. Application Data

[63] Continuation of application No. 08/699,767, Aug. 20, 1996, abandoned.

[30] Foreign Application Priority Data

Aug. 22, 1995 [JP] Japan ..... 7-213839

[51] Int. Cl.[6] ..... B41J 29/387

[52] U.S. Cl. ..... 400/74; 400/279; 400/705.1

[58] Field of Search ..... 400/74, 319, 279, 400/705.1

[56] References Cited

U.S. PATENT DOCUMENTS

| | | | |
|---|---|---|---|
| 4,315,268 | 2/1982 | Tazaki . | |
| 4,669,900 | 6/1987 | Miyake et al. . | |
| 5,029,264 | 7/1991 | Ito et al. . | |
| 5,087,134 | 2/1992 | Tanuma et al. | 400/74 |
| 5,594,653 | 1/1997 | Akiyama et al. | 395/114 |
| 5,664,222 | 9/1997 | Inakoshi . | |

FOREIGN PATENT DOCUMENTS

| | | |
|---|---|---|
| 0 287 804 | 10/1988 | European Pat. Off. . |
| 0 607 871 | 7/1994 | European Pat. Off. . |
| 0 641 117 | 3/1995 | European Pat. Off. . |
| 55-161681 | 12/1980 | Japan . |
| 58-219079 | 12/1983 | Japan . |
| 61-74874 | 4/1986 | Japan . |
| 62-158070 | 7/1987 | Japan . |
| 62-264981 | 11/1987 | Japan . |
| 2-072984 | 3/1990 | Japan . |
| 06 255195 | 9/1994 | Japan . |

*Primary Examiner*—John Hilten
*Attorney, Agent, or Firm*—Eric B. Janofsky

[57] ABSTRACT

The printer of the present invention prevents loss of print data due to print operation malfunction after the completion of the initialization of print head 3 by detecting error conditions related to the motion of the print head during the initialization of the print head. In the initialization process of print head 3, print head 3 is moved until it is detected by reference position detector 16 located at the left edge of the print area of the printer; after completion of the initial-position detection for print head 3, print head 3 is moved over the entire print area to rightmost move position 37. By moving print head 3 as described above and by checking whether or not the print head has moved correctly, it is possible to detect any error conditions relating to the motion of print head 3.

23 Claims, 4 Drawing Sheets

PRINTING APPARATUS AND A CONTROL METHOD THEREOF

This is a Continuation of application Ser. No. 08/699,767 filed Aug. 20, 1996 now abandoned.

BACKGROUND OF THE INVENTION

1. Field of the Invention

This invention relates to a so-called serial printer that prints by moving the print head relative to the recording medium. In particular, the present invention relates to a technique of preventing a loss of print data when the print head does not move correctly. Therefore, the present invention relates to a technology that is strongly related to printers used in systems that handle monetary data, such as POS/ECR.

2. Description of the Related Art

Because of its structure, a serial printer needs to know the position of the print head. This is because without knowing the current print head position, the printer is unable to print accurately at a given position even when a print position on the recording medium is specified. In this sense, the printer also needs to know the position at which the recording medium is mounted.

In order to set the print head at its initial position, a conventional serial printer moves the print head in a specified direction until the print head is detected by the print head reference position detector. Because the reference position detector normally is provided at one end of the printable area, the direction of motion is uniquely determined as the direction from the current position of the print head toward the reference position detector. If a reference position is not detected even when the drive motor is operated to an extent equivalent to the amount of motion of the print head corresponding to the width of the printable area, the printer determines that the print head cannot be set at its initial position, and terminates processing by stopping the carriage motor. Incidentally, the process or operation of setting the print head at its initial position is referred to as the initialization of the print head, or, simply, as initialization.

Serial printers are used as output terminals for various information-processing devices. In particular, they are often used in systems that are involved in handling of money, such as POS/ECR systems. Confirming the details of transactions in writing is deep-rooted in the customary use of these systems, and transaction data is always printed. Therefore, for handling monetary transactions using such a system, the results of printing are critical; in such a system, the accuracy and reliability of print results are of paramount importance.

The information-processing devices and associated printers discussed above are normally used by operators of varying skill levels. Therefore, it is important that the printer be able to print reliably, regardless of the operator. With a printer, an especially important requirement is the absence of printing malfunction that could lead to a loss of print data.

In the conventional initialization operation discussed above, it is possible to determine whether or not the moving operation was performed correctly by moving the print head from the current position to the reference position and by setting the print head at the reference position. In other words, if the reference position is not detected during the above initialization operation, it is possible to infer that moving of the print head to the reference position was not performed correctly due to some kind of error.

The range in which the print head is moved by this processing, however, does not necessarily encompass the entire area in which the print head can print. Therefore, the initialization processing cannot detect error conditions in the entire area. In other words, even if the initialization operation has normally terminated, problems could exist in the parts of the print area through which the print head did not pass. These problems include a protruding recording medium in the path of print head motion, the presence of foreign objects, or an error in the print head transport mechanism. Conventional methods cannot detect these problems.

Therefore, conventionally it is possible that printing is performed even if such a print hindering condition exists. In such a case, the print data which the printer has received from the information-processing equipment is liable to be erased from the printer before it can be printed in a form amenable to visual inspection. This can be a serious problem especially in POS/ECR systems involved in handling of money.

OBJECTS OF THE INVENTION

Therefore, it is an object of the present invention to overcome the aforementioned problems.

It is another object of the present invention to provide a printer which can print accurately at a given position.

It is a further object of the present invention to provide an improved printing apparatus and its control method which are able to detect potential errors in transferring the print head previously to the printing operations.

SUMMARY OF THE INVENTION

According to a first aspect of the present invention, a printer is provided with the following means: a print head; a print head drive means; a reference position detection means that detects the reference position of the print head; a reference position return means that moves the print head to the reference position; a print control means that performs printing on the recording medium by means of the print head while moving the print head; a print head move verification means that detects whether or not the print head has moved normally; a print area scanning means that moves the print head over the entire area of a predetermined printable area after the reference position is detected by the reference position detection means; and an error processing means that performs error processing, including disabling the print control means from performing printing operations if it is detected that the print head did not move normally when the print head was being moved by the print area scanning means.

In accordance with the present invention, the printer moves the print head provisionally to a reference position and moves the print head over the entire area of the printable area in order to examine whether or not the motion was performed correctly. In this manner the printer can detect the presence of any obstacles over the entire printable area that tends to thwart the motion of the print head. If an obstacle is found, the printer performs an error processing that disables the execution of printing on the recording medium. This prevents the loss of print data during the printing operation that would occur if the motion of the print head failed during the printing operation.

It is preferable that in this case the print head move verification means comprise a print head move detection means that generates move detection signals in accordance with moving of the print head, and a signal compare means that compares the move detection signals with drive signals that are supplied to the print head drive means. In this case, the printer detects that the motion of the print head is normal if the move detection signals are in correspondence with the drive signals, and otherwise detects that the motion of the print head is not normal.

This enables the printer to detect the error immediately if an error occurs in the motion of the print head, thus minimizing damage to the print head moving mechanism due to the error.

Moreover, the print head move verification means can also comprise a print head move detection means that generates move detection signals in accordance with moving of the print head, and a signal count compare means that compares the number of the move detection signals with a predetermined value. In this case, the printer detects that the print head moved normally if the number of move detection signals is equal to the predetermined value; and, otherwise, detects that the motion of the print head is not normal.

This enables the printer accurately to detect any error in print head motion even if there is a change in the phase difference between drive signals for moving the print head and the move detection signals.

Moreover, the print area scanning means can be configured such that it moves the print head over the entire printable area from the reference position to the reference position, and the print head move verification means can comprise a drive signal count compare means that compares the number of drive signals generated by the print area scanning means with a predetermined value. In this case, the print area scanning means detects that the print head has moved normally if the number of drive signals is equal to the predetermined value, and, otherwise, the print area scanning means detects that the print head did not move normally.

This enables the printer to detect print head moving errors over the entire print area with a simple configuration, without requiring the provision of a special means to generate signals in response to the motion of the print head.

On the other hand, preferably the print control means should be provided with an interface means that performs communications with an external device; also, the error processing means should be constituted so that it can transmit the print head error status to the external device. This enables the printer to notify the external device if a print head motion error is detected in order to induce the external device to disable the transmission of print data.

Furthermore, the drive force generated by the print head drive means in response to drive signals that are output by the print area scanning means preferably should be smaller than the drive force generated in response to drive signals that are output by the print control means. This allows the printer to accurately move the print head during normal printing operation in which the print head is moved by a larger drive force if no print head moving error is detected when the print area is scanned.

In this case, the print head drive means uses a stepping motor, and the drive signals for the stepping motor preferably should be signals that correspond to the energizing current for the stepping motor. In this case, a current larger than that used for scanning of the print area is supplied to the stepping motor during a normal printing operation.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The following is a detailed explanation of the invention with reference to drawings.

Figure 1:
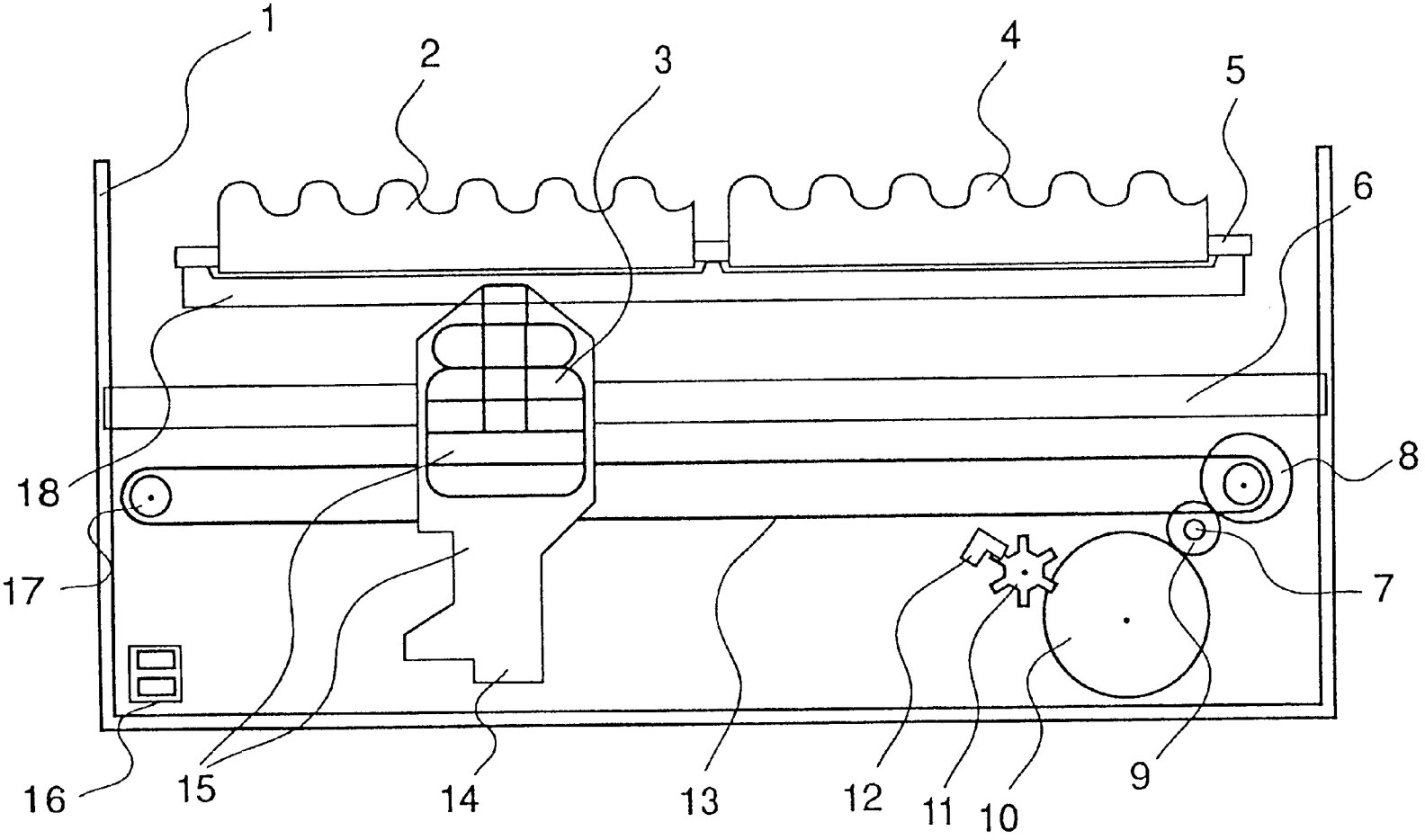
FIG. 1 is a plan schematic view of the printer in an embodiment of the present invention.

FIG. 1 shows a schematic plan view of a printer, which is an embodiment of the present invention. In particular, the figure only shows components that are involved in printing operations. The printer of the present embodiment houses receipt paper 2 and journal paper 4 in a parallel configuration. These items are arranged in parallel along the path through which print head 3 moves. The printer is also provided with a print head unit 15 that moves along carriage guide axis 6 in a direction that is across receipt paper 2 and journal paper 4. The print head unit comprises a print head 3 and a carriage 14 on which print head 3 is mounted.

Carriage 14 is supported on carriage guide axis 6. The lower portion of carriage 14 is connected to a part of carriage belt 13. In the figure, carriage belt 13 is hung from carriage belt pulley 17 located at the left edge of body 1 to carriage-belt drive gear 8 located at the right edge of body 1. As carriage-belt drive gear 8 rotates, carriage belt 13 also rotates forming an ellipse whose long axis extends from left to right. And, as carriage belt 13 rotates, print head unit 15 is moved parallel to carriage guide axis 6 by the part of the print head unit that is connected to carriage belt 13.

Carriage-belt drive gear 8 is engaged with stepping-motor gear 9. As stepping-motor gear 9 rotates, the carriage-belt drive gear rotates in the direction opposite of the rotation of stepping-motor gear 9. Stepping-motor gear 9 is directly linked to stepping-motor rotary axis 7. When the stepping motor control circuit, which is not shown in the figure, rotates stepping-motor rotary axis 7, the stepping-motor gear rotates in the same direction as the rotation of the stepping motor.

Stepping-motor gear 9 is also engaged with transfer gear 10. As stepping-motor gear 9 rotates, transfer gear 10 rotates in the direction opposite of the rotation of stepping-motor gear 9. Transfer gear 10 is engaged with star-shaped gear 11. As transfer gear 10 rotates, star-shaped gear 11 rotates in the direction opposite of the rotation of transfer gear 10. Star-shaped gear 11 comprises six blade-shaped plates, the blade being disposed in equal intervals. The blade-shaped plates are arranged in positions that can be detected by motion detector 12 which detects the motion of print head 3.

Motion detector 12 incorporates, for example, a photo-interrupter or the like. The photo-interrupter generates pulse signals when a blade-shaped plate on star-shaped gear 11 passes by the detector in the photosensor. The pulse signals are used as motion detection signals. Control unit 21 for the printer in the present embodiment, shown in FIG. 2, confirms that print head unit 15 has moved correctly based upon the number of pulse signals generated by motion detector 12.

Figure 2:
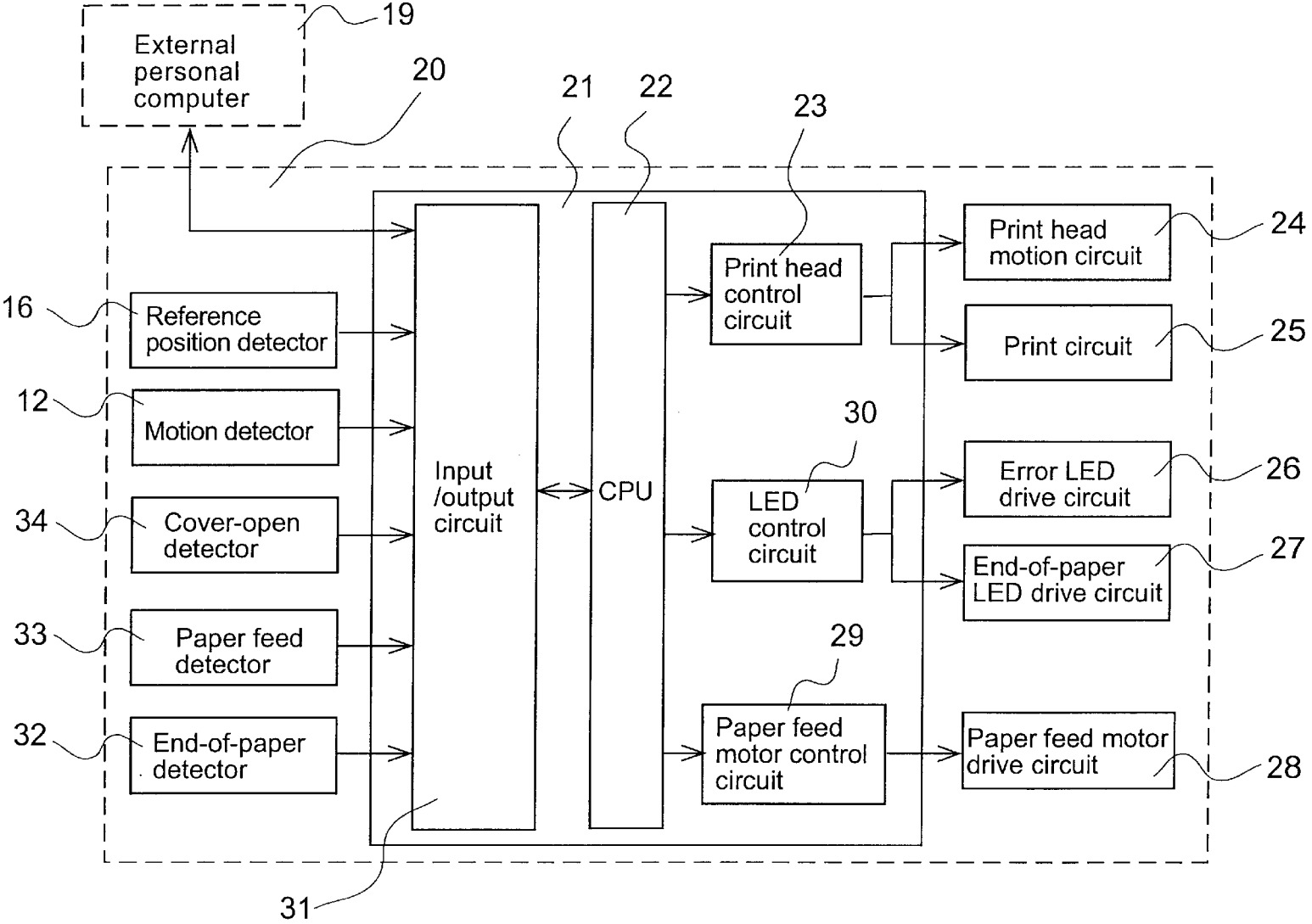
FIG. 2 is a block diagram of the control system of the printer shown in FIG. 1.

Thus, each time that a drive signal for moving print head 3 is supplied to the stepping motor by head motion circuit 24 shown in FIG. 2, control unit 21 detects signals from motion detector 12, i.e., the presence or absence of a motion detection signal. In other words, the control unit detects the presence or absence of a motion detection signal by comparing drive signals with motion detection signals. As a result, if a motion detection signal is not generated, the control unit 21 determines that some kind of error has occurred in the motion of the print head. In this case, the stepping motor has produced a condition known as an out-of-step condition. Therefore, the detection process that determines whether or not a motion has been performed correctly is sometimes referred to as an out-of-step detection.

A reference position detector 16 is located on the left edge of body 1. Reference position detector 16 incorporates a built-in photo-interrupter or the like. In the figure, the photo-interrupter generates a reference position detection signal as print head unit 15 moves to the left of body 1 and a part of carriage 14 passes by the detector unit on the photosensor. When reference position detector 16 has generated a reference position detection signal, head motion circuit 24, shown in FIG. 2, stops the rotation of the stepping motor and halts the motion of print head unit 15.

At this time, the rotation step count for the stepping motor is set to 0 indicating the position at which print head unit 15 halted as the reference position. By counting the successive number of rotation steps by the stepping motor from the position at which the rotation step count for the stepping motor was set to 0, it is possible to determine the current position of print head unit 15, based upon the rotation step count for the stepping motor that was counted.

FIG. 2 shows a block diagram of the control system for the printer in the present embodiment. The printer in the present embodiment is provided with a control unit 21 that controls the operation of the entire printer. Connected to input/output circuit 31 for control unit 21 is a host such as an external personal computer 19, which is information-processing equipment not included in the printer in the present embodiment. The external personal computer transmits print data and other data to the printer.

Print data, control commands, and other types of information related to printing are input from personal computer 19 to input/output circuit 31, which provides an interface with external devices. Control unit 21, which is principally composed of CPU 34, executes printing operations on the print paper through print head control circuit 23 and other circuits, based upon the input information.

Also input into input/output circuit 31 is information that indicates the status of reference position detector 16, motion detector 12, cover-open detector 34, paper-feed detector 33, and end-of-paper detector 32. The detector information thus input is processed by control unit 21. Based upon this information, control unit 21 controls print head motion circuit 24, print circuit 25 for driving print elements provided in the print head 3, error LED drive circuit 26, end-of-paper LED drive circuit 27, and paper feed motor drive circuit 28 through print head control circuit 23, LED control circuit 30, and paper-feed motor control circuit 29, respectively.

In response to instructions from head control circuit 23, head motion circuit 24 in the present embodiment can generate two types of drive signals with different drive torque to the stepping motor (not shown), which is a print head drive means. This is because the drive signal specifies the current values to be supplied to magnetization phases of the stepping motor. By varying the current specification value between the two types of the drive signals, it is possible to vary the drive torque generated by the stepping motor.

When printing, head control circuit 23 directs head motion circuit 24 to output drive signals that generate a larger drive torque; on the contrary, during print head move verification processing, to be described later, i.e., processing steps ST4, ST5, and ST7 in FIG. 4, the head control circuit provides an instruction to output drive signals that generate a smaller drive torque. If the print head is moved correctly in the print head motion verification processing, this ensures that the print head is moved accurately in the normal printing operation in which the print head is moved using a larger drive torque.

The above circuits can easily be realized using constant-current drivers in which a current value can be set, digital/analog converters, and voltage/current converters. Therefore, a detailed description of the above circuits is omitted.

Figure 3:
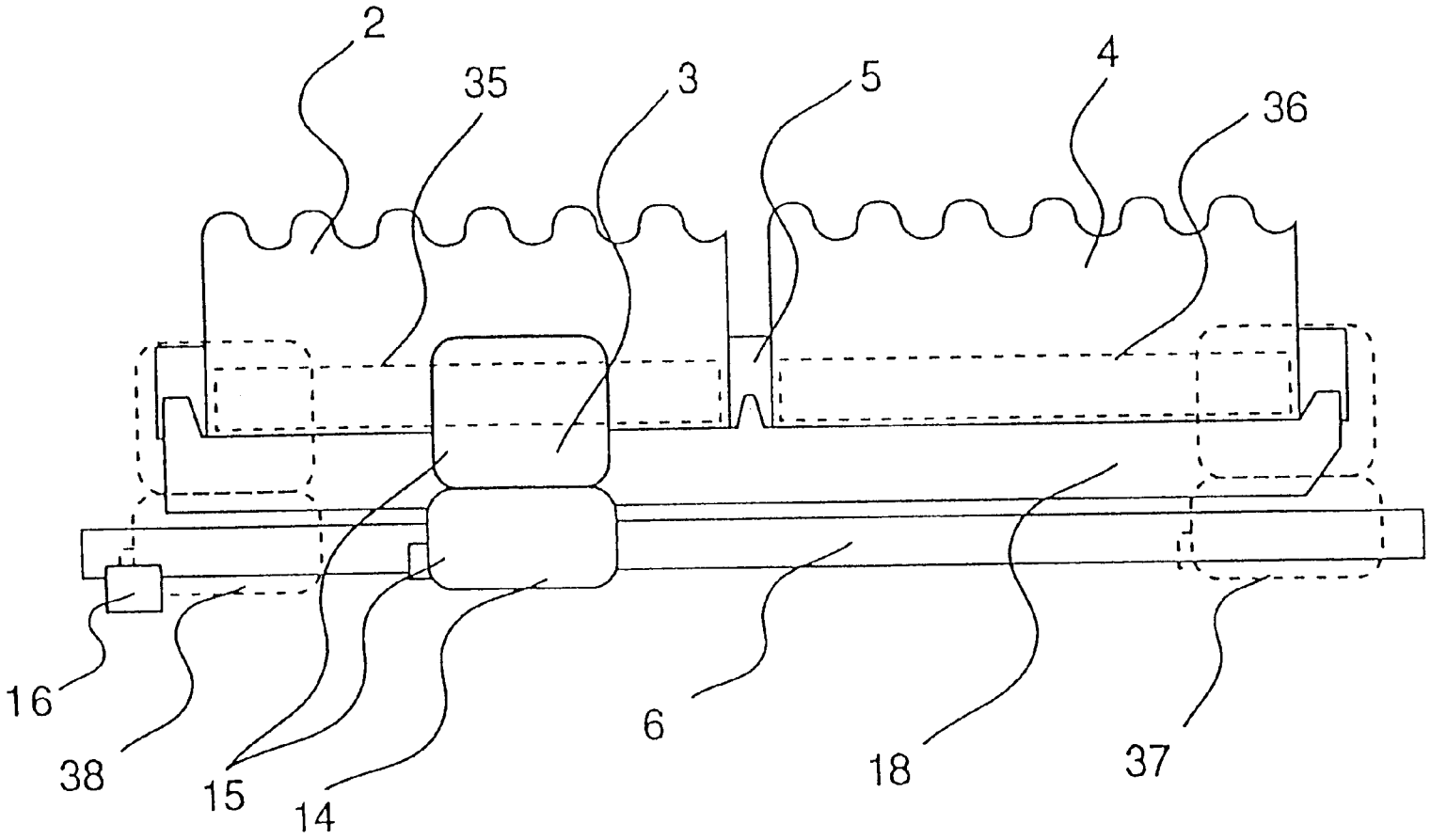
FIG. 3 is a schematic front view of the printer shown in FIG. 1.

The following is an explanation of the initialization at power-on time, and the operation following the initialization, of print head unit 15 with reference to FIG. 3. Before initialization, print head unit 15 may be located at any position between the leftmost move position, 38, or the rightmost move position, 37. At which position the print head unit will be located before its initialization is indeterminate. In particular, immediately after the power is turned on, control unit 21 does not have any information about the present position of the print head unit.

When its initialization commences, print head unit 15 begins to move from its pre-initialization position to the left edge of body 1, at which reference position detector 16 is provided. When print head unit 15 has reached the leftmost move position, 38, indicated by the broken line, print head unit 15 stops in accordance with the reference position detector signal generated by reference position detector 16.

In a conventional initialization operation, the initialization operation terminates when print head unit 15 halts at the initial position predetermined relative to the reference position, e.g., the leftmost move position 38 in the embodiment. Subsequently, the input of print data from personal computer 19 initiates a printing operation.

However, if print head unit 15 is located in receipt paper print area 35 before initialization and there are no paper troubles in this area, and, for example, a paper jam has occurred in which journal paper 4 has protruded beyond paper-holding leaf spring 18 onto the moving path of print head 3, print head unit 15 passes through receipt paper print area 35 without any trouble and assumes a standby position at leftmost move position 38. In the next step, the print head unit begins a printing operation because of a printing instruction from personal computer 19 to receipt paper 2 and journal paper 4. After correctly printing on receipt paper 2, print head unit 15 attempts to print on journal paper 4. However, journal paper 4 has a paper jam, and consequently printing is not executed correctly and the printing operation terminates abnormally.

When a printing operation commences, any print data received from personal computer 19 is sequentially erased from a print buffer in the printer. Therefore, if the printing operation terminates abnormally, as described above, the data is lost without being printed in a condition that affords visual inspection.

On the contrary, in the present invention, reference position detector 16 detects the position of print head unit 15 during the initialization of print head unit 15, and then print head unit 15 is moved through the entire printable area from leftmost move position 38 to rightmost move position 37. In this manner, the present invention achieves the detection of anomalies anywhere in the entire printable area. The entire printable area refers to sheet paper print area 35 and journal paper print area 36, which are located between leftmost move position 38 and rightmost move position 37 in FIG. 3.

Figure 4:
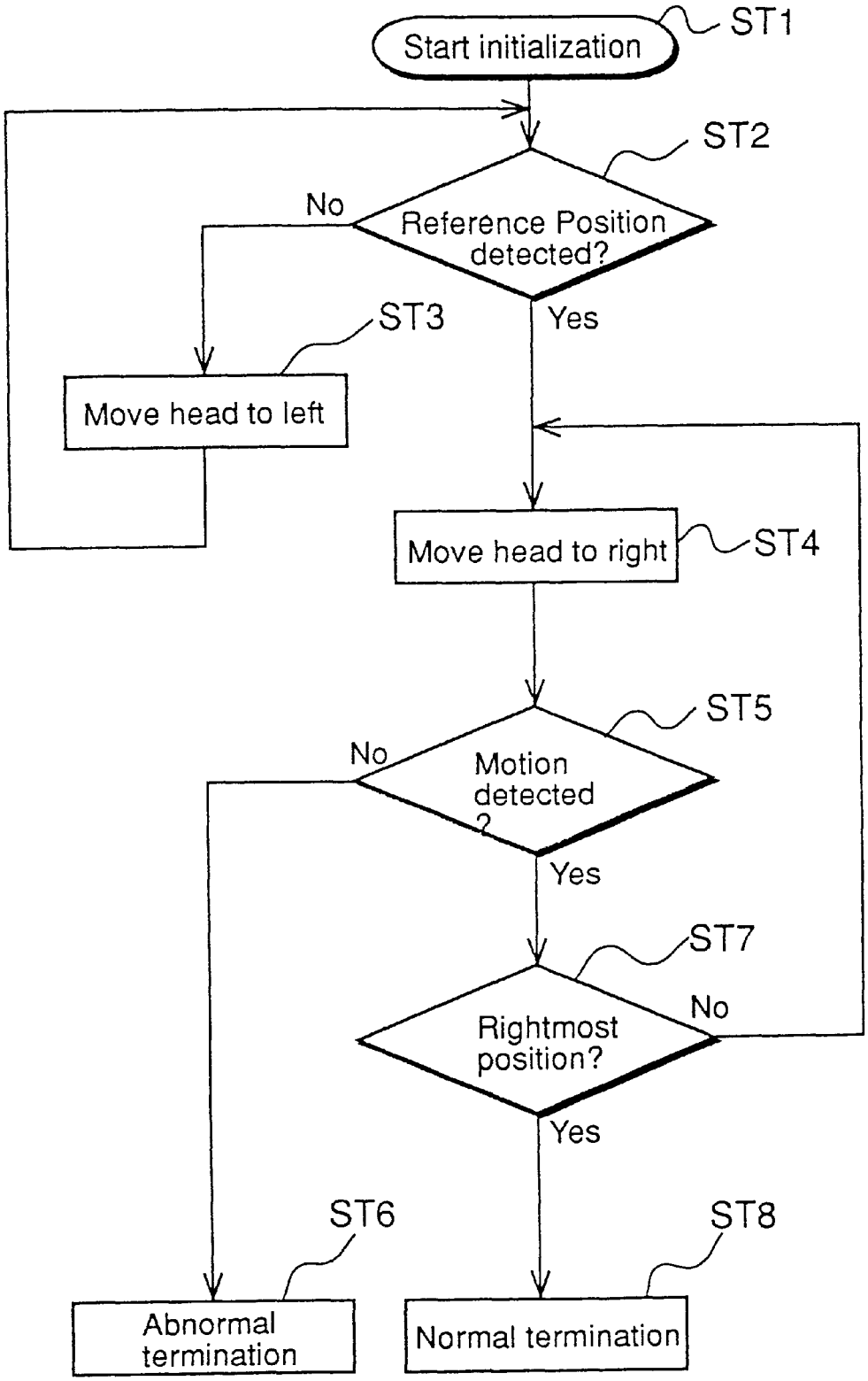
FIG. 4 is a flowchart showing an example of print head control procedure of the control system shown in FIG. 2.

The following is an explanation of the flow of initialization operations in the present invention, shown in FIG. 4, with reference to FIGS. 1 and 3.

When an initialization operation is commenced in Step ST1, Step ST2 examines whether or not reference position detector 16 has generated a reference position detection signal. If reference position detector 16 did not generate a reference position detection signal, control proceeds to Step ST3, which moves print head unit 15 by one step to the left of body 1. Steps ST2 and ST3 are repeated until such time as a reference position detection signal is generated by reference position detector 16. Note that it is possible to check the print head motion by motion detector 2 and proceed to abnormal termination ST6 if a corresponding motion is not detected.

When a reference position detection signal is generated by reference position detector 16 in Step ST2, control proceeds to Step ST4. In Step ST4, print head unit 15 is moving one step toward the right side of the printer followed by Step ST5 which examines whether or not the motion of the print head has been detected by motion detector 12. If no signals were generated by motion detector 12, i.e., it was detected that a motion was not performed correctly, control proceeds to Step ST6, where an error processing is performed.

The error processing, at a minimum, disables printing. This can prevent any loss of print data caused by a motion error during printing. In order to alert personal computer 19 not to transmit any further print data, the error processing also transmits an error status that indicates a printer error to personal computer 19 through the interface. If there is no print data sent from the personal computer in the printer, the printer may go to an error condition in which all functions of the printer are halted until the printer is reset by, for example, re-application of the power. In this case, the operator has to turn off the power and turn it on again after removing the cause of the error state, e.g., the paper jam. On the other hand, if there are some print data remained in the printer, the printer goes into a standby condition in which the printer asserts error condition against personal computer 19. Additionally LED control circuit 30 and error LED drive circuit 26 cause an LED to flash on an operation panel (not shown in the drawings). The printer then waits for an error recovery instruction from the personal computer or the operator through a switch provided on the operation panel. However, it is desirable to maintain assertion of the error condition against the personal computer during the initialization procedure to prevent the print data from being sent to the printer.

On the other hand, if a signal was generated by motion detector 12 in Step ST5, i.e., if the motion of the print head is detected, control proceeds to Step ST7. Step ST7 checks the number of drive steps for the stepping motor to determine whether or not print head unit 15 is at rightmost move position 37.

In Step ST7, if print head unit 15 has not reached rightmost move position 37, control loops to Step ST4. Steps ST4, ST5, and ST7 are performed repeatedly until print head unit 15 reaches rightmost move position 37 which is determined if predetermined number of driving pluses are generated. In Step ST7, if print head unit 15 has reached rightmost move position 37, control proceeds to Step ST8. This indicates a normal termination of the initialization of print head unit 15.

The text above described the initialization of print head unit 15 in conjunction with the operation of turning the power on. Print head motion verification over the entire printable area, as described above, can also be performed after print head unit 15 is initialized when the printer cover is opened and then closed or when receipt paper is cut in order to issue a receipt. Errors relating to the motion of print paper or print head unit 15 are likely to occur when the power for the printer is turned on, the printer cover is opened and then closed, or when receipt is issued. Therefore, it is effective to perform the initialization operation in each cases.

Although in the present embodiment the printer is constructed using a motion detector that performs a one-step feed and outputs an associated signal to indicate the absence of an error in the motion of the print head over the entire printable area, this should not be construed as limiting the present invention.

An out-of-step condition, for example, can also be detected by generating a prescribed number of drive signals, counting the number of motion detection signals that are generated when the print head is moved a prescribed distance, and by comparing the counted signals with the predetermined number of signals. This method is effective in cases in which a motion method is employed in which the relationship varies between the phases of drive signals and the phases of motion detection signals, e.g., when a stepping motor acceleration/deceleration drive method is employed.

Furthermore, a reference position detector can also be used for verifying the motion of the print head instead of the motion detector of the above embodiment. That is, this method involves causing print head 3 to make a reciprocation from the reference position to the reference position and comparing the number of drive signals required during that operation with a prescribed number. The number of drive signals generated in the reciprocation can be prescribed because the distance that the print head travels in the reciprocation is known. Alternatively, this number of drive signals can be generated to determine whether or not the reference position is re-detected by the time the drive signals are exhausted. If there is a match between the number of steps traveled by the print head and the distance from the reference position to the reference position, it can be concluded that the print head has moved correctly over the entire print area; otherwise, an error processing can be performed on the assumption that some kind of error has occurred in the motion of the print head at some location within the print area.

Note that the initial positions differ from each other in accordance with printer types mentioned above. One is provided with the carriage motion detector, the other uses the reference position detector for carriage motion detection. In the former type, the carriage initialization is terminated when the carriage reaches the farther end of the printable area from the references position. In this case, the carriage is moved first to the reference position, then to the nearer end of the printable area, and finally to the farther end. And, the initial position is the farther end. In the latter type, the carriage is first moved to the reference position, then reciprocated once to the nearer end, and then reciprocated once to the farther end, and finally moved to the nearer end. Namely the initial position is the nearer end of the printable area to the reference position.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

Reference Numerals

1 . . . Body
2 . . . Receipt paper
3 . . . Print head
4 . . . Journal paper
5 . . . Platen
6 . . . Carriage guide axis
7 . . . Stepping-motor rotary axis
8 . . . Carriage-belt drive gear
9 . . . Stepping-motor gear
10 . . . Transfer gear
11 . . . Star-shaped gear
12 . . . Motion detector
13 . . . Carriage belt
14 . . . Carriage
15 . . . Print head unit
16 . . . Reference position detector
17 . . . Carriage belt pulley
18 . . . Paper-holding leaf spring
19 . . . External personal computer
20 . . . Printer
21 . . . Control unit
22 . . . CPU
23 . . . Print head control circuit
24 . . . Print head motion circuit
25 . . . Print head print circuit
26 . . . Error LED drive circuit
27 . . . End-of-paper LED drive circuit
28 . . . Paper feed motor drive circuit
29 . . . Paper feed motor control circuit
30 . . . LED control circuit
31 . . . Input/output circuit
32 . . . End-of-paper detector
33 . . . Paper feed detector
34 . . . Cover-open detector
35 . . . Receipt paper print area
36 . . . Journal paper print area
37 . . . Rightmost position
38 . . . Leftmost position

What is claimed is:

1. A printing apparatus comprising:

a print head for printing on a recording medium;

print head drive means for moving said print head relative to the recording medium;

at least one reference position detection means for detecting a reference position of said print head;

reference position return control means for moving said print head to the reference position in accordance with said reference position detection means;

print control means for controlling said print head drive means to move said print head and for controlling said print head to print on the recording medium;

print head move verification means for detecting whether said print head has moved normally;

print area scanning control means for moving prior to any printing operation said print head over an entire printable area defined based on the reference position detected by said reference position detection means; and error processing means for performing error processing, if said print head move verification means detects that said print head moved abnormally when said print head was being moved by said print area scanning control means.

2. A printing apparatus according to claim 1, wherein the error processing comprises disabling said print control means from controlling said print head.

3. A printing apparatus according to claim 1, wherein:

said print head move verification means comprises:

print head move detection means for generating move detection signals in accordance with moving of said print head; and signal compare means for comparing the move detection signals generated by said print head move detection means with drive signals supplied by said print control means to said print head drive means; and wherein said print head move verification means determines that said print head has moved normally, if the move detection signals are in correspondence with the drive signals, and determines that said print head moved abnormally, if there is an absence of correspondence with the move detection signals and the drive signals.

4. A printing apparatus according to claim 1, wherein:

said print head move verification means comprises;

a print head move detection means for generating move detection signals in accordance with moving of said print head, and a signal-count compare means for comparing a number of the move detection signals generated by said print head move detection means with a predetermined value; and wherein said print head move verification means (1) determines that said print head has moved normally if the number of the move detection signals generated by said print head move detection means is equal to the predetermined value; and (2) determines that said print head moved abnormally if the number of the move detection signals is different from the predetermined value.

5. A printing apparatus according to claim 1, wherein:

said print area scanning control means moves, in accordance with said reference position detection means, said print head to the reference position;

said print head move verification means comprises a drive signal count compare means for comparing a number of drive signals generated by said print area scanning means with a predetermined value; and wherein said print head move verification means (1) determines that said print head has moved normally if the number of said drive signals is equal to said predetermined value; and (2) determines that said print head moved abnormally if the number of said drive signals is different from said predetermined value.

6. A printing apparatus according to claim 1, wherein said print control means comprises interface means for:

(1) receiving print data from an external device; and (2) transmitting a status of said printer apparatus to the external device; and wherein said error processing means transmits an error status of said printer apparatus to the external device in communication with said interface means.

7. A printing apparatus according to claim 1, wherein a drive force generated by said print head drive means in accordance with said print area scanning means is smaller than a drive force generated by said print head drive means in accordance with said print control means.

8. A printing apparatus according to claim 7, wherein:

said print head drive means comprises a stepping motor; and said print head drive means supplies drive signals corresponding to a value of energizing current for said stepping motor.

9. A control method for a printing apparatus comprising a print head for printing on a recording medium, a print head driver for moving the print head relative to the recording medium, at least one reference position detector for detecting a reference position of the print head; comprising the steps of:

moving, by supplying drive signals to the print head driver, the print head to the reference position in accordance with the reference position detector;

defining a printable area based on the reference position detected by the reference position detector;

supplying drive signals to the print head drive means;

printing on the recording medium by means of the print head in accordance with the supplied drive signals while moving the print head;

verifying whether the print head has moved normally;

scanning, by supplying drive signals to the print head drive means, the print head over all of the printable area prior to said printing step; and performing error processing, if the print head is detected in said print head move verification step that the print head moved abnormally when the print head was being moved in said print area scanning step.

10. A control method according to claim 9, wherein said print head move verification step comprises the steps of:

generating move detection signals in accordance with moving of the print head;

comparing the move detection signals generated during said move detection signal generation step with the drive signals supplied to the print head drive means;

determining that the print head has moved normally if the move detection signals are in correspondence with the drive signals; and determining that the print head moved abnormally if there is an absence of correspondence between the move detection signals and the drive signals.

11. A control method according to claim 9, wherein said print head move verification step comprises the steps of:

generating move detection signals in accordance with moving of the print head, comparing a number of the move detection signals generated during said move detection signal generation step with a predetermined value;

determining that the print head has moved normally if the number of the move detection signals is equal to the predetermined value; and determining that the print head moved abnormally if the number of the move detection signals is different from the predetermined value.

12. A control method according to claim 11 wherein:

said print area scanning step comprises the step of moving the print head to the reference position in accordance with the reference position detection means; and said print head move verification step comprises the steps of;

comparing a number of the drive signals generated during said print area scanning step with a predetermined value;

determining that the print head has moved normally if the number of the drive signals is equal to the predetermined value; and determining that the print head moved abnormally if the number of the drive signals is different from the predetermined value.

13. A control method according to claim 9, wherein said error processing step further comprises the step of transmitting error status of the printing apparatus to an external device, wherein the external device provides print data for printing by the print medium.

14. A control method according to claim 9, further comprising the step of generating a drive force by the print head drive means in correspondence with the drive signals output in said print area scanning step which is smaller than a drive force generated by the print head drive means in correspondence with the drive signals output in said print control step.

15. A control method according to claim 14, wherein the print head drive means is provided with a stepping motor and the drive signals correspond to the energizing current for the stepping motor.

16. A control method according to claim 9, wherein said print area scanning step is performed in correspondence with at least one of the following:

turning the power on for the printer;

one of opening and closing the cover for covering the print head move area; and cutting the recording paper.

17. A control method according to claim 9, wherein said error processing step comprises disabling of the print control means from controlling the print head.

18. A printing apparatus comprising:

a print head for printing on a recording medium;

print head driver for moving said print head relative to the recording medium;

at least one reference position detector for detecting a reference position of said print head;

reference position return controller for moving said print head to the reference position in accordance with said reference position detector;

print controller for controlling said print head driver to move said print head and for controlling said print head to print on the recording medium;

print head move verifier for detecting whether said print head has moved normally;

print area scanning controller, said controller moving prior to any printing operation said print head over an entire printable area defined based on the reference position detected by said reference position detector; and error processor, said processor performing error processing, if said print head move verifier detects that said print head moved abnormally when said print head was being moved by said print area scanning controller.

19. A method of initializing a printing apparatus comprising a print head for printing on a recording medium, a print head driver for moving the print head relative to the recording medium, at least one reference position detector for detecting a reference position of the print head; comprising the steps of:

moving, by supplying drive signals to the print head driver, the print head to the reference position in accordance with the reference position detector;

supplying drive signals to the print head drive means;

printing on the recording medium by means of the print head in accordance with the supplied drive signals while moving the print head;

verifying whether the print head has moved normally;

scanning, by supplying drive signals to the print head drive means, the print head over an entire predetermined printable area prior to said printing step and after the print head is moved to the reference position as detected by the reference position detector in said moving step; and performing error processing, if the print head is detected in said print head move verification step that the print head moved abnormally when the print head was being moved in said print area scanning step.

20. A printing apparatus comprising:

a print head for printing on a recording medium;

print head drive means for moving said print head relative to the recording medium;

print control means for controlling said print head drive means to move said print head and for controlling said print head to print on the recording medium;

print head move verification means for detecting whether said print head has moved normally;

print area scanning control means for moving prior to any printing operation said print head over an entire predetermined printable area; and error processing means for performing error processing, if said print head move verification means detects that said print head moved abnormally when said print head was being moved by said print area scanning control means.

21. A control method for a printing apparatus comprising a print head for printing on a recording medium, a print head driver for moving the print head relative to the recording medium, comprising the steps of:

supplying drive signals to the print head drive means;

printing on the recording medium by means of the print head in accordance with the supplied drive signals while moving the print head;

verifying whether the print head has moved normally;

scanning, by supplying drive signals to the print head drive means, the print head over an entire predetermined printable area prior to said printing step; and performing error processing, if the print head is detected in said print head move verification step that the print head moved abnormally when the print head was being moved in said print area scanning step.

22. A printing apparatus comprising:

a print head for printing on a recording medium;

print head driver for moving said print head relative to the recording medium;

print controller for controlling said print head driver to move said print head and for controlling said print head to print on the recording medium;

print head move verifier for detecting whether said print head has moved normally;

print area scanning controller for moving prior to any printing operations said print head over an entire predetermined printable area; and error processor for performing error processing, if said print head move verifier detects that said print head moved abnormally when said print head was being moved by said print area scanning controller.

23. A method of initializing a printing apparatus comprising a print head for printing on a recording medium, a print head driver for moving the print head relative to the recording medium; comprising the steps of:

supplying drive signals to the print head drive means;

printing on the recording medium by means of the print head in accordance with the supplied drive signals while moving the print head;

verifying whether the print head has moved normally;

scanning, by supplying drive signals to the print head drive means, the print head over an entire predetermined printable area prior to said printing step; and performing error processing, if the print head is detected in said print head move verification step that the print head moved abnormally when the print head was being moved in said print area scanning step.

* * * * *

UNITED STATES PATENT AND TRADEMARK OFFICE

CERTIFICATE OF CORRECTION

PATENT NO. : 6,000,865
DATED : December 14, 1999
INVENTOR(S) : Yuji Takamizawa, et al.

It is certified that errors appear in the above identified patent and that said Letters Patent is hereby corrected as shown below:

Column 10, line 1, change "any" to --a--.

Column 12, line 47, insert --a-- before "reference position".

line 55, change ", said controller" to --for--.

line 56, change "any" to --a--.

line 60, insert --an-- before "error processor".

line 60, change ", said processor" to --for--.

Column 13, line 32, change "any" to --a--.

Column 14, line 14, insert --a-- before "print head".

line 16, insert --a-- before "print controller".

line 19, insert --a-- before "print head".

line 21, insert --a-- before "print area".

line 21, change "any" to --a--.

line 24, insert --an-- before "error processor".

UNITED STATES PATENT AND TRADEMARK OFFICE

CERTIFICATE OF CORRECTION

PATENT NO. : 6,000,865
DATED : December 14, 1999
INVENTOR(S) : Yuji Takamizawa, et al.

It is certified that errors appear in the above identified patent and that said Letters Patent is hereby corrected as shown below:

Column 14, line 44, insert the following two claims:

--24. A printer according to Claims 18 or 22, wherein the printing operation comprises a first printing operation, and wherein said print area scanning controller moves said print head over the entire predetermined printable area prior to the first printing operation after at least one of:

turning the power on the printer;

one of opening and closing the cover for covering a print head move area; and cutting the recording medium.

25. A printer according to Claims 1 or 20, wherein the printing operation comprises a first printing operation, and wherein said print area scanning control means moves said print head over the entire predetermined printable area prior to the first printing operation after at least one of:

UNITED STATES PATENT AND TRADEMARK OFFICE

CERTIFICATE OF CORRECTION

PATENT NO. : 6,000,865

DATED : December 14, 1999

INVENTOR(S) : Yuji Takamizawa, et al.

It is certified that error appears in the above-identified patent and that said Letters Patent is hereby corrected as shown below:

turning the power on the printer;

one of opening and closing the cover for covering a print head move area; and cutting the recording medium.--

Signed and Sealed this

Thirtieth Day of January, 2001

*Attest:*

*Attesting Officer*

Q. TODD DICKINSON

*Director of Patents and Trademarks*